US007367778B2

(12) United States Patent
Bachofner et al.

(10) Patent No.: US 7,367,778 B2
(45) Date of Patent: May 6, 2008

(54) ROTOR END PIECE

(75) Inventors: René Bachofner, Untersiggenthal (CH); Pietro Grigioni, Ehrendingen (CH); Wolfgang Kappis, Fislisbach (CH)

(73) Assignee: ALSTOM Technology Ltd., Baden (CH)

( * ) Notice: Subject to any disclaimer, the term of this patent is extended or adjusted under 35 U.S.C. 154(b) by 150 days.

(21) Appl. No.: 11/276,296

(22) Filed: Feb. 23, 2006

(65) Prior Publication Data

US 2006/0257248 A1 Nov. 16, 2006

(30) Foreign Application Priority Data

Feb. 23, 2005 (CH) ..... 00323/05

(51) Int. Cl.
*F01D 5/32* (2006.01)

(52) U.S. Cl. ..... 416/215; 416/221

(58) Field of Classification Search ..... 29/889.21; 416/221, 215

See application file for complete search history.

(56) References Cited

U.S. PATENT DOCUMENTS 2,410,588 A 11/1946 Phelan et al.
3,778,191 A * 12/1973 Brockmann ..... 416/215
4,633,554 A * 1/1987 Clark et al. ..... 29/888
4,915,587 A * 4/1990 Pisz et al. ..... 416/221

FOREIGN PATENT DOCUMENTS

| | | |
|---|---|---|
| DE | 724549 | 8/1942 |
| DE | 812337 | 8/1951 |
| DE | 820598 | 11/1951 |
| DE | 1040047 | 10/1958 |
| DE | 10310432 | 9/2004 |
| EP | 1215367 | 6/2002 |

OTHER PUBLICATIONS

Search Report for Swiss Patent App. No. CH 3233005 (Jun. 2, 2005).

* cited by examiner

*Primary Examiner*—Richard A. Edgar
(74) *Attorney, Agent, or Firm*—Cermak Kenealy & Vaidya LLP; Adam J. Cermak

(57) ABSTRACT

A rotor end piece (1) for a rotor (6) of a thermal turbomachine, having at least one circumferential slot (3) in which moving blades and intermediate pieces are provided, includes a residual gap (15) formed between an end blade (2) and an end part (11), in which residual gap (15) two end piece halves (4, 4) are arranged which have securing tabs (8, 8) which are in each case connected to the latter in one piece and are in engagement with the end blade (2) and with the end part (11), respectively.

7 Claims, 3 Drawing Sheets

ROTOR END PIECE

This application claims priority to Swiss patent application no. 00323/05, filed 23 Feb. 2005, the entirety of which is incorporated by reference herein.

BACKGROUND OF THE INVENTION

1. Field of the Invention

The invention relates to the field of thermal turbomachines, and in particular it relates to a rotor end piece for rotors, as well as a method of fitting a rotor end piece.

2. Brief Description of the Related Art

Thermal turbomachines including axial-flow turbines and axial-flow compressors have a rotor fitted with moving blades and a stator in which guide blades are suspended in order to guide the flow.

The task of the stationary guide blades is to direct the flow of the gaseous medium to be compressed or expanded onto the rotating moving blades of the respective compressor stage or the respective turbine stage in such a way that the energy conversion is effected with the best possible efficiency.

Both moving blades and guide blades essentially have a profiled airfoil and a blade root. In order to be able to fasten the moving blades on the rotor or the guide blades in the stator, slots are recessed in the stator and on the rotor shaft. The roots of the blades are pushed into these slots and locked there.

It is known that compressor blade rows of gas turbine rotors are arranged in circumferential slots, which often have a T-shaped cross section. As a rule, blades and intermediate pieces alternate with one another here. During the fitting of such blade rows, a special solution has to be found for the last blades to be fitted, since the remaining fitting opening for a complete intermediate piece is then too small. This residual opening is therefore filled with a "rotor end piece".

DE 812 337 discloses such a rotor end piece. The known rotor end piece includes an intermediate piece divided in half, that is to say of two end piece halves split in the circumferential direction with respect to the rotor, and a wedge, by means of which the end piece halves are axially caulked in the rotor.

In the known prior art according to DE 812 337, the two end piece halves each have a straight side face. These side faces are opposite one another in the installed state, the wedge then being located between them. Once the two end piece halves and the wedge have been installed, tabs formed on the top side of the wedge are finally bent into corresponding undercuts in the side faces of the end piece halves, and the wedge and thus the entire end piece are secured.

A disadvantage with this prior art is that, at high rotor speeds, strength problems may occur on account of the tilting moment of the two end piece halves, which is caused by the centrifugal force during operation.

A further disadvantage of these technical solutions consists in the fact that end pieces exert axial forces onto the rotor, on the one hand due to the centrifugal force during operation and on the other hand due to the caulking of the wedge. In the search for the causes of the frequently occurring rotor vibrations, it has been found that these axial forces can bend the rotor and thereby adversely generate disturbing vibrations.

EP 1 215 367 A2 and DE 103 10 432 A1 certainly describe solution proposals in which the forces are directed into the adjacent blades, i.e., in the circumferential direction. However, the solutions presented here are complicated and costly to fit and produce.

SUMMARY OF THE INVENTION

One aspect of the present invention is, therefore, in avoiding disadvantages of the prior art. The technical problem forming a basis of the invention is to provide a rotor end piece which can be fitted and produced as simply and as cost-effectively as possible.

As a result, the disadvantages of the prior art can be avoided and a rotor end piece is provided which can be fitted and produced in a simple and cost-effective manner.

In yet another aspect of the present invention, a rotor end piece for a rotor of a thermal turbomachine, having at least one circumferential slot in which moving blades, in particular with a hammer root, and intermediate pieces are provided, is characterized in that a residual gap is formed between an end blade and an end part, in which residual gap two end piece halves are arranged which have securing tabs which are in each case connected to the latter in one piece and are in engagement with the end blade and with the end part, respectively. In a solution according to the invention, there is no wedge, i.e., no forces are applied to the rotor in the axial direction. This is possible on account of the small residual gap related to the design. Due to the fact that there are only two components, the fitting is very simple and cost-effective. In this case, the proposed rotor end piece is reliable and causes no rotor vibrations.

An advantageous development of the invention provides for the tabs to be arranged at the parting plane of the end piece halves. This facilitates the fitting and removal of the end piece halves.

A further advantageous development of the invention provides for the end blade and the end part to each have a recess in the root region, on the side facing the residual gap, into which recess the tabs of the end piece halves can be directed. The end blade and the end part differ from the remaining moving blades due to the recess. The recess can be designed, for example, in a cylinder segment shape and can be cut by means of a grinding tool.

Yet another advantageous development of the invention provides for the end piece halves to have a material thickness of 3 mm to 5 mm. This makes it possible to bend the tabs using a simple fitting tool.

In addition, it has proved to be advantageous for the end piece halves to be made of a chrome-molybdenum-vanadium alloy. This ensures the desired strength of the rotor end piece.

Finally, yet another advantageous development of the invention provides for the end piece halves to have relief slots below the tabs. This likewise contributes to the simple manual bendability of the tabs and thus to simple fitting of the rotor end piece. In addition, this prevents the end piece halves from twisting during the bending of the tabs.

Yet another aspect of the present invention includes a method for fitting a rotor end piece in a circumferential slot, the rotor end piece having two end piece halves, including the following steps: inserting the two end piece halves into the residual gap together with supports, so that the end piece halves are offset from one another; inserting a tool into the parting plane between the two end piece halves; bending the tabs into the recesses of the end blade and of the end part; removing the supports.

An advantageous development of the method according to the invention for fitting a rotor end piece also comprises the following steps: turning the tool by 90° so that the tabs project far enough into the recess.

BRIEF DESCRIPTION OF THE DRAWINGS

Further advantages of the invention are described in more detail below with reference to a preferred exemplary embodiment of the invention and the figures. In the drawing.

The illustration in the attached figures is effected schematically by way of example. In each case the same components are provided with the same designations in the figures. Furthermore, only the elements essential for the understanding of the invention are shown.

DETAILED DESCRIPTION OF EXEMPLARY EMBODIMENTS

Figure 1:
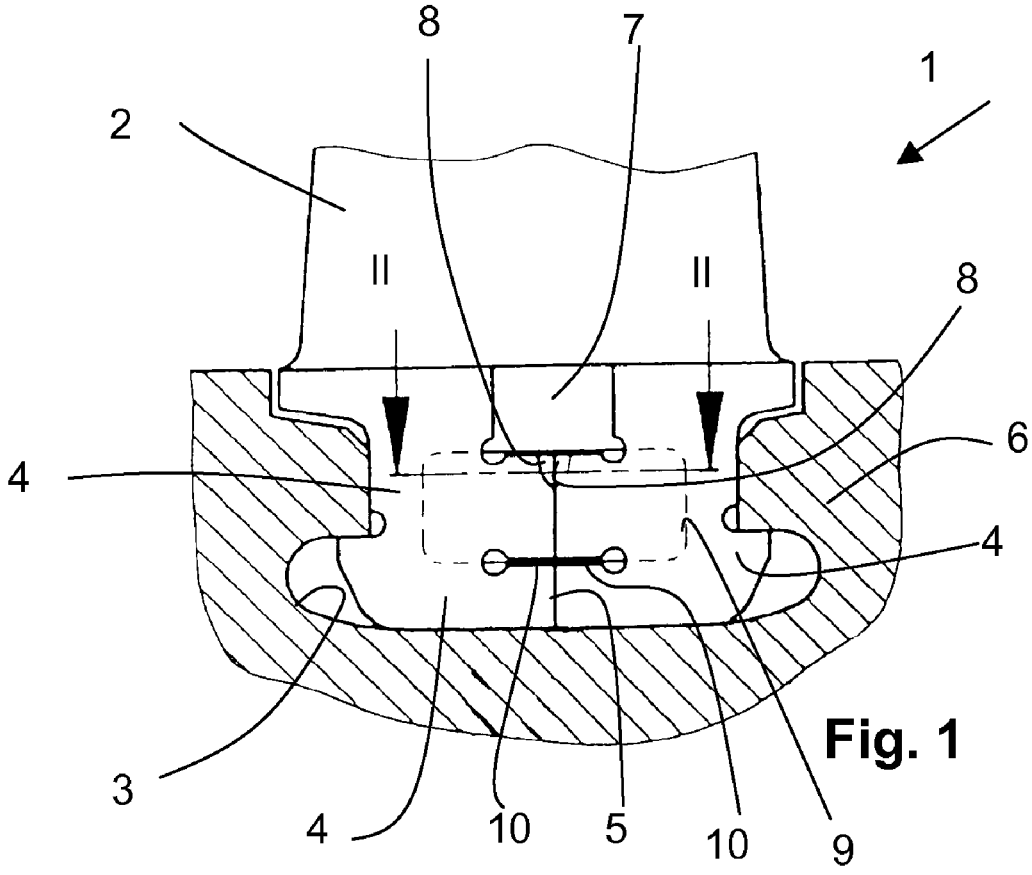
FIG. 1 shows a section in the rotor longitudinal direction through a rotor end piece according to the invention after it has been installed in a compressor rotor.
Figure 2:
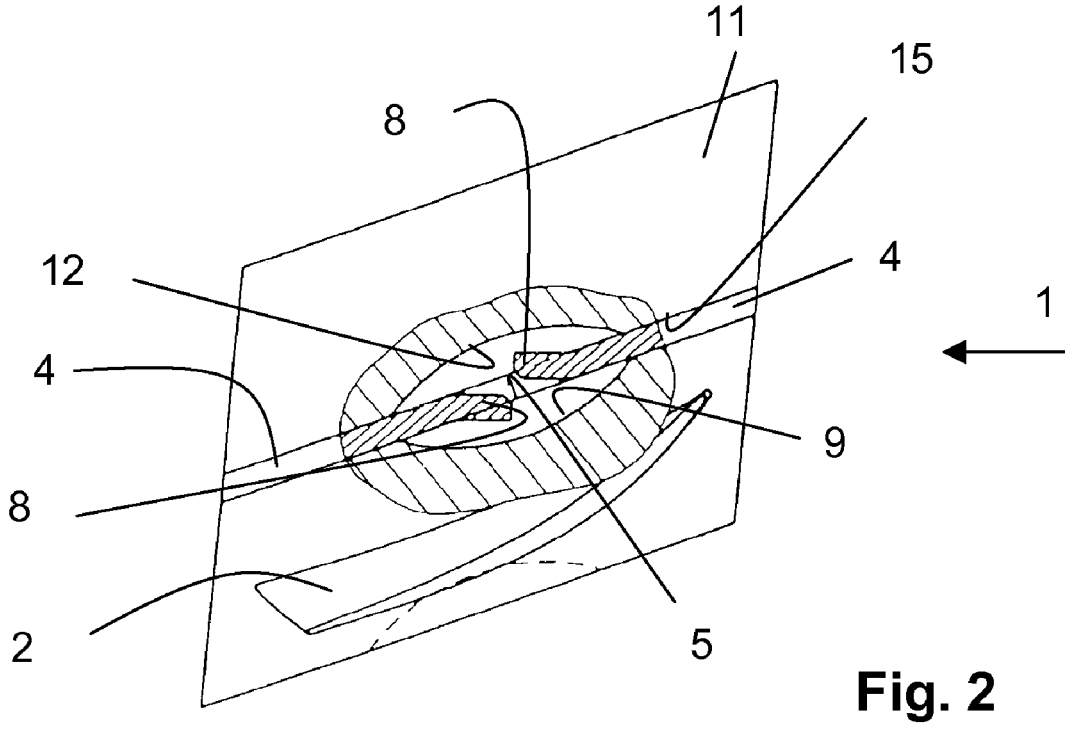
FIG. 2 shows a partial section along line II-II in FIG. 1.

FIG. 1 shows a section in the rotor longitudinal direction through a rotor end piece 1 according to the invention after it has been installed in a compressor rotor 6. FIG. 2 shows a partial section along line II-II in FIG. 1.

A residual gap 15 between an end blade 2 and an end part 11 is filled by two end piece halves 4, 4. In this case, the flat end piece halves 4, 4 essentially have a cross section which corresponds to a "hammer root" or "bifurcated root", a rectangular area being cut out above the parting plane 5. Bendable tabs 8, 8 are arranged at the top corners, adjoining the rectangular aperture, of the end piece halves 4, 4. Below the tabs 8, 8, the end piece halves 4, 4 have relief slots 10, 10.

In the root region, on the side facing the residual gap 15, the end blade 2 and the end part 11 each have a recess 9, 12, into which the tabs 8, 8 of the end piece halves 4, 4 can be directed by bending. The rotor end piece 1 is locked and secured against falling out by means of the tabs 8, 8 bent into the recesses 9, 12.

Figure 3:
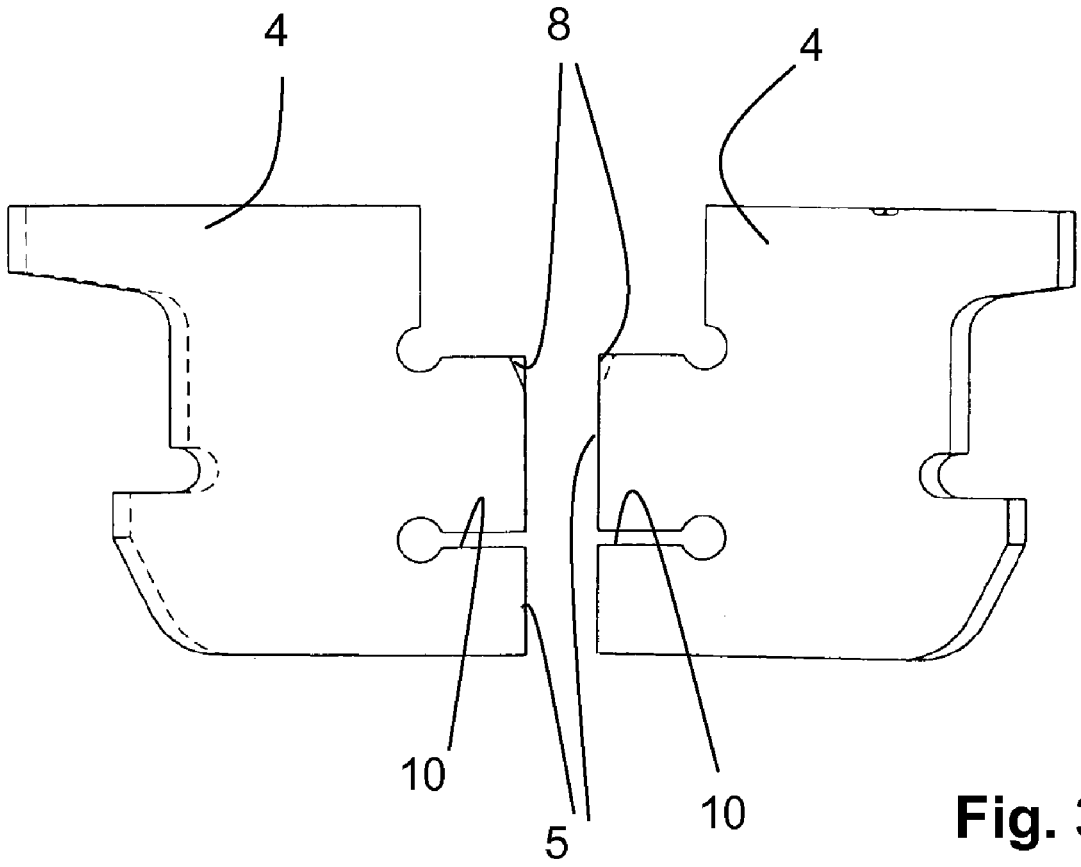
FIG. 3 shows an enlarged detailed view of the two end piece halves.

FIG. 3 shows an enlarged detailed view of the two end piece halves 4, 4. Here, the end piece halves 4, 4 are opposite one another with their parting plane 5. Cut out above the parting plane 5 is a rectangular area which allows a tool to reach the two tabs arranged at the top edge of the parting plane 5. Arranged below the tabs 8, 8 are horizontal relief slots 10, which each start in the parting plane 5 and end in a hole. The outer contour of the end piece halves 4, 4 is designed in such a way that they can be inserted into a T-shaped circumferential slot 3 of a rotor 6 and are retained therein.

Figure 4:
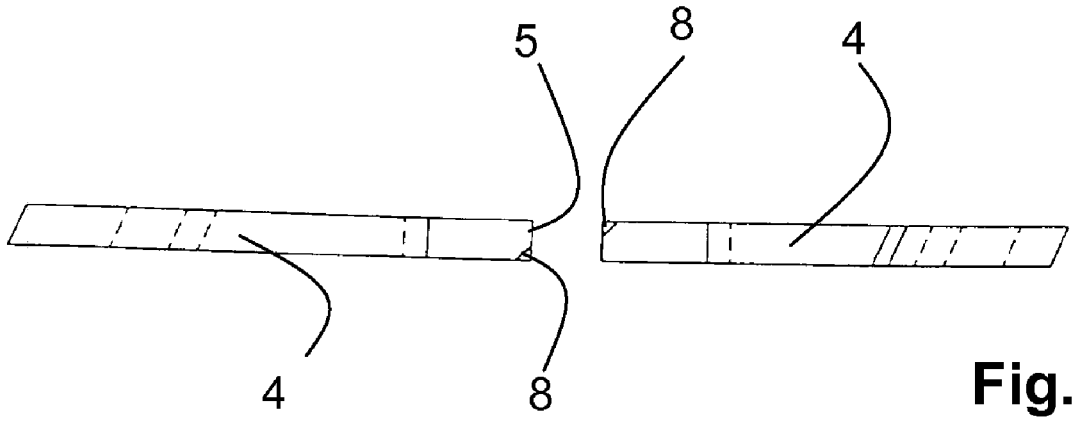
FIG. 4 shows a plan view of the end piece halves in FIG. 3.

As can be seen from FIG. 4, which shows a plan view of the end piece halves 4, 4 from FIG. 3, the end piece halves only have a small thickness of 3 mm to 5 mm. This also enables the tabs 8, 8 to be bent over manually.

Figure 5:
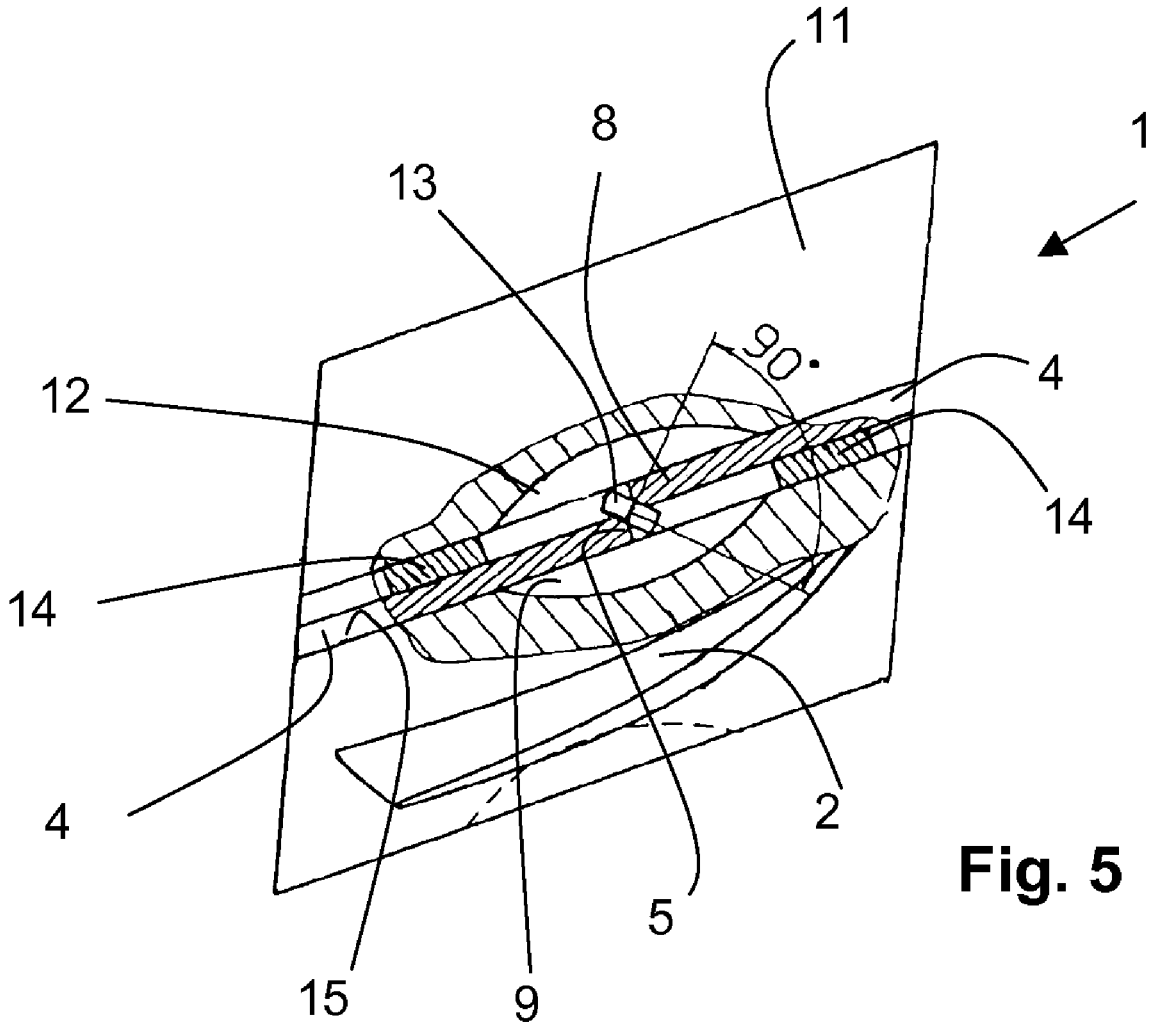
FIG. 5 shows a partial section which corresponds to that in FIG. 2 but with supports introduced during the fitting.

FIG. 5 shows a partial section which corresponds to that of FIG. 2, but with supports introduced during the fitting.

Once all the moving blades and intermediate pieces and the end blade 2 and the end part 11 have been fitted in the circumferential slot 3, a residual gap 15 remains. Only the rotor end piece 1, consisting of two end piece halves 4, 4 split in the circumferential direction of the slot 3, together with supports 14, 14 can be accommodated in this residual gap 15. In this case, the supports 14, 14 serve merely as a fitting aid for the two 3 mm to 5 mm thick end piece halves 4, 4, which are made of a chrome-molybdenum-vanadium alloy. The supports 14, 14 in this case are just as thick as the end piece halves 4, 4 or are slightly thinner.

The two tabs 8, 8 are bent out of the end piece plane using an appropriate tool 13, for example a screwdriver or a flat chisel, which is pushed 10 mm-15 mm into the parting plane 5 between the two end piece halves 4, 4.

In the process, the tool 13 is turned preferably by 90° so that the tabs 8, 8 project far enough into the recess 9 at the blade root and respectively into the recess 12 at the end part. The respective recesses 9, 12 are in this case incorporated as cylinder-segment-like depressions in the end blade root 7 and the end part root, as a result of which the components differ from the remaining moving blades and intermediate pieces. The supports 14, 14 required merely for the fitting are then removed and the minimum gap is evenly distributed over the circumference. The final configuration is shown and described in FIGS. 1 and 2.

Dismantling is effected by boring away or by grinding away the tabs 8, 8 and by removing the end piece halves 4, 4.

LIST OF DESIGNATIONS

1 Rotor end piece
2 End blade
3 Circumferential slot
4 End piece half
5 Parting plane
6 Rotor
7 Blade root
8 Tab
9 Recess at blade root
10 Relief slot
11 End part
12 Recess at end part root
13 Tool
14 Support
15 Residual gap While the invention has been described in detail with reference to exemplary embodiments thereof, it will be apparent to one skilled in the art that various changes can be made, and equivalents employed, without departing from the scope of the invention. Each of the aforementioned documents is incorporated by reference herein in its entirety.

What is claimed is:

1. A rotor end piece for a rotor of a thermal turbomachine having at least one circumferential slot in which moving blades and intermediate pieces are positioned, the rotor end piece comprising:

an end blade;

an end part, a residual gap formed between the end blade and the end part; and two end piece halves each having a securing tab, said end piece halves positioned in the residual gap, the securing tabs in engagement with the end blade and with the end part;

wherein the end piece halves include relief slots below the securing tabs.

2. The rotor end piece as claimed in claim 1, wherein the securing tabs are arranged at a parting plane of the end piece halves.

3. The rotor end piece as claimed in claim 1, wherein the end blade and the end part each have a recess in a root region, on a side facing the residual gap, into which recess the securing tabs of the end piece halves can be directed.

4. The rotor end piece as claimed in claim 1, wherein the end piece halves have a thickness of 3 mm to 5 mm.

5. The rotor end piece as claimed in claim 1, wherein the end piece halves are made of a chrome-molybdenum-vanadium alloy.

6. A method of fitting a rotor end piece in a circumferential slot, said rotor end piece having two end piece halves, each end piece half including a securing tab, the method comprising:

inserting the two end piece halves into a residual gap with supports, so that the end piece halves are offset from one another;

inserting a tool into a parting plane between the two end piece halves;

bending the tabs into recesses of an end blade and of an end part; and removing the supports.

7. A method of fitting a rotor end piece as claimed in claim 6, further comprising:

turning the tool by 90° so that the tabs project into the recesses.

* * * * *